US009889988B2

(12) United States Patent
Degnan

(10) Patent No.: US 9,889,988 B2
(45) Date of Patent: Feb. 13, 2018

(54) WASTE RECEPTACLE ATTACHMENT FOR COMPOSTING KITCHEN WASTE

(71) Applicant: Nicholas Michael Degnan, Redondo Beach, CA (US)

(72) Inventor: Nicholas Michael Degnan, Redondo Beach, CA (US)

( * ) Notice: Subject to any disclaimer, the term of this patent is extended or adjusted under 35 U.S.C. 154(b) by 0 days.

(21) Appl. No.: 15/340,942

(22) Filed: Nov. 1, 2016

(65) Prior Publication Data

US 2017/0121104 A1 May 4, 2017

Related U.S. Application Data

(60) Provisional application No. 62/249,311, filed on Nov. 1, 2015.

(51) Int. Cl.

| | |
|---|---|
| ***B65B 67/12*** | (2006.01) |
| ***B65F 1/00*** | (2006.01) |
| ***B65F 1/14*** | (2006.01) |
| ***B65F 1/06*** | (2006.01) |

(52) U.S. Cl.

CPC ..... *B65F 1/002* (2013.01); *B65F 1/06* (2013.01); *B65F 1/14* (2013.01); *B65F 2001/1489* (2013.01); *B65F 2250/105* (2013.01)

(58) Field of Classification Search

CPC ..... B65F 1/1415; B65F 1/06; B65F 2240/138
USPC ..... 248/95, 99, 100, 101
See application file for complete search history.

(56) References Cited

U.S. PATENT DOCUMENTS

| | | | | |
|---|---|---|---|---|
| 637,248 | A * | 11/1899 | Hagstrom | B65B 67/12 248/101 |
| 2,235,182 | A * | 3/1941 | Weston | B65B 67/1255 248/100 |
| 3,838,839 | A * | 10/1974 | Spencer | B65F 1/1415 248/222.41 |
| 6,416,023 | B1 * | 7/2002 | Satsky | B65B 67/12 248/99 |
| 6,637,938 | B2 * | 10/2003 | Watkins | D06F 95/004 248/99 |
| 8,240,626 | B2 * | 8/2012 | Kennedy | B65F 1/1452 220/23.4 |
| 9,310,018 | B2 * | 4/2016 | Laitila | A47F 13/085 |
| 2003/0019981 | A1 * | 1/2003 | Stanfield | B65B 67/1233 248/101 |
| 2011/0139806 | A1 * | 6/2011 | Kullman | B65F 1/068 220/810 |

* cited by examiner

*Primary Examiner* — Steven M Marsh
(74) *Attorney, Agent, or Firm* — Edwin Tarver

(57) ABSTRACT

An apparatus for separately storing compostable material in a kitchen waste receptacle has a holder panel with an adjustable releasable attachment for suspending the apparatus in the waste receptacle and a cradle panel connected to the holder panel with a hinge, the cradle panel movable between a first position coplanar with the holder panel and a second position non-coplanar with the holder panel. The cradle panel includes a lock for releasably engaging the holder panel to maintain the cradle panel in the first position. A bag retainer seated in an aperture holds a compost bag, and the bag retainer positions the opening of the compost bag such that the opening is occluded when the cradle panel is in the first position, and the opening is clear when the cradle panel is in the second position.

20 Claims, 5 Drawing Sheets

WASTE RECEPTACLE ATTACHMENT FOR COMPOSTING KITCHEN WASTE

RELATED APPLICATIONS

This application claims the benefit of the priority filing date of U.S. provisional patent application Ser. No. 62/249,311, entitled "Waste Collection Device," which was filed on Nov. 1, 2015.

BACKGROUND

The present invention generally relates to waste collection. More specifically, the present invention relates to collection of organic waste in a sealed apparatus adjacent a conventional waste receptacle.

Collecting and separating various forms of household kitchen waste is increasingly prevalent, as it reduces the quantity of residential waste sent to landfills. Separated organic waste from cooking and similar activities is typically stored in compost bins. When full, such compost bins may be emptied into a composting apparatus and reused.

Due to frequency of use, compost bins typically reside in or adjacent a user's kitchen, where the user must locate or create a convenient storage space for the compost bin. Compost bins currently known in the art are sized for keeping in a bottom cabinet or may be designed for installation in kitchen walls or cabinets, or those of an adjoining room. Some compost bins are simply placed on a kitchen countertop.

These existing products often take up a large amount of space and may be difficult to keep out of sight, requiring decorative elements to help hide the compost bin or help it blend in with kitchen decor. Other existing compost bins focus on functionality, offering different ways to open the receptacle and discard its contents. Some have features promoting a composting process in the receptacle, with a focus on air flow, a specialized shape, or even a mechanism for churning the organic waste.

Existing compost bins have various shortcomings making organic waste collection for composting a difficult and undesirable process. For example, having any receptacle filled with organic waste exposed on a countertop is undesirable. In some cases, insufficient space is available, and no matter where located, compost bins are messy by their very nature. Due to odors of decomposing organic waste, even after a few hours, compost bins must be lidded to avoid becoming a nuisance. Decomposing organic waste is also wet, thus opening and closing such a receptacle is messy regardless of the care exercised by a user. Larger compost bins maintained in cabinets or in adjoining rooms avoid the unsightly appearance of countertop compost bin, but are inconvenient due to their distance from food preparation areas, and due to their size which can make emptying theirs difficult. Furthermore, many existing products use a substantial amount of plastic or other material, which is counterproductive in terms of resource use and taking up landfill space when discarded.

As with any new technology designed to help conserve resources, a compost bin is more readily adopted if made as easy as possible to install and use. Hence, what is needed is a compost bin that segregates organic waste for composting away from direct contact with the ambient air, which is sized appropriately for quantities of organic waste typically produced in residential kitchens, which can be hidden away but is still located at or near food preparation areas without the limitations of existing techniques, and which is less messy.

SUMMARY

An apparatus for isolating compostable material in a kitchen waste receptacle includes a holder panel having a releasable attachment for suspending the apparatus in the waste receptacle and a cradle panel having art aperture, with the cradle panel hingedly coupled to the holder panel and movable between a first position coplanar with the holder panel and a second position non-coplanar with the holder panel. A bag retainer is seated in the aperture for releasably holding a compost bag therebetween, with the bag retainer defining an opening of the compost bag. The opening is occluded by the waste receptacle, and hanging compost bag and waste when the cradle panel is in the first position, and the opening is clear when the cradle panel is in the second position.

The holder panel may include an arced portion in substantially peripheral contour with the aperture, and the bag retainer may extend through the arced portion when the cradle panel is brought against the holder panel in the first position. Optionally, the releasable attachment may comprise hook members positionally adjustable relative to the holder panel, and the cradle panel may include a lock for releasably engaging the holder panel, thereby maintaining the cradle panel in the first position if the apparatus is not in use.

For ease of compost bag installation, the aperture is preferably elliptical, with the bag retainer extending through the aperture. The bag retainer preferably includes a lip which is larger in circumference than the aperture, and at least one catch opposite the lip for releasably engaging the aperture. A hinge mechanism couples the cradle panel to the holder panel, and may include an articulating strut and slider channel to urge the cradle panel along the waste receptacle when opening to ensure clear folding to the closed position.

An alternative embodiment apparatus for collecting compostable organic kitchen waste is characterized by a compost bag having an opening turned around a bag retainer, with the bag retainer seated in an aperture of a cradle panel, such that the compost bag is held between the bag retainer and the aperture. The cradle panel is hingedly coupled to a holder panel, and the cradle panel is configured to rotate the bag retainer sufficient to occlude the opening with the compost bag.

The opening preferably faces a waste receptacle when cradle panel rests against the holder panel, and an adjustable releasable attachment is coupled to the holder panel for suspending the apparatus in a waste receptacle. The cradle panel also comprises a lock for releasably engaging the holder panel, with the lock comprising a thumb tab for grasping the cradle panel. The bag retainer extends through the aperture and the aperture and the bag retainer define an ellipse for east of installation of the bag retainer in the aperture. The bag retainer also comprises a lip larger in circumference than the aperture, and a catch for releasably engaging the aperture. Preferably the compost bag is biodegradable.

DETAILED DESCRIPTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not limited to the embodiments shown, but is to be accorded the widest scope consistent with the principles and features disclosed herein.

Figure 1:
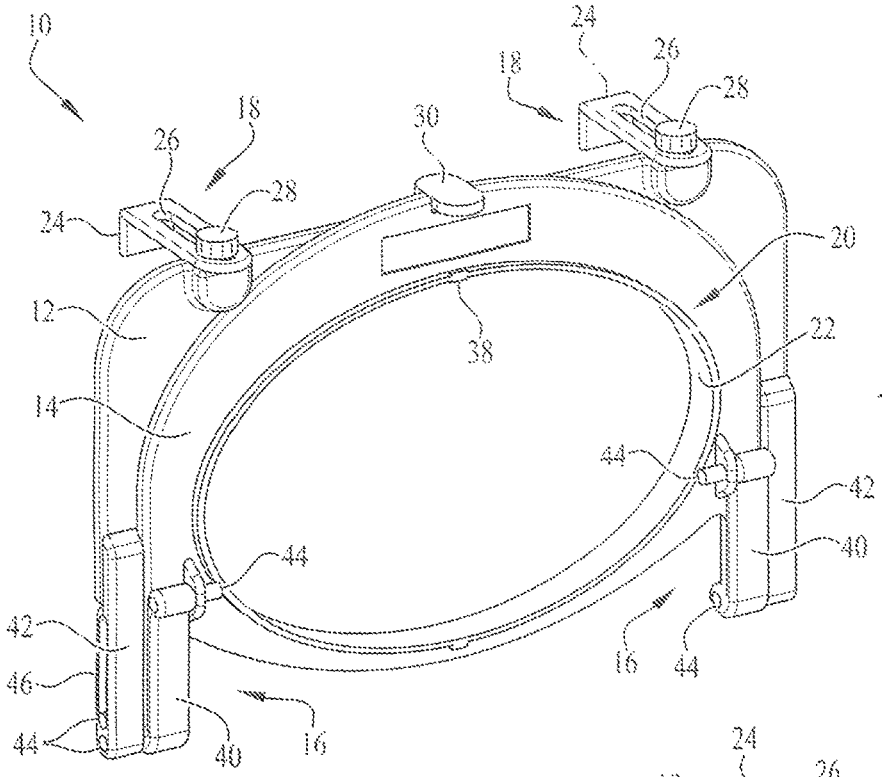
FIG. 1 illustrates a compost collecting apparatus for waste receptacles in a closed configuration.
Figure 2:
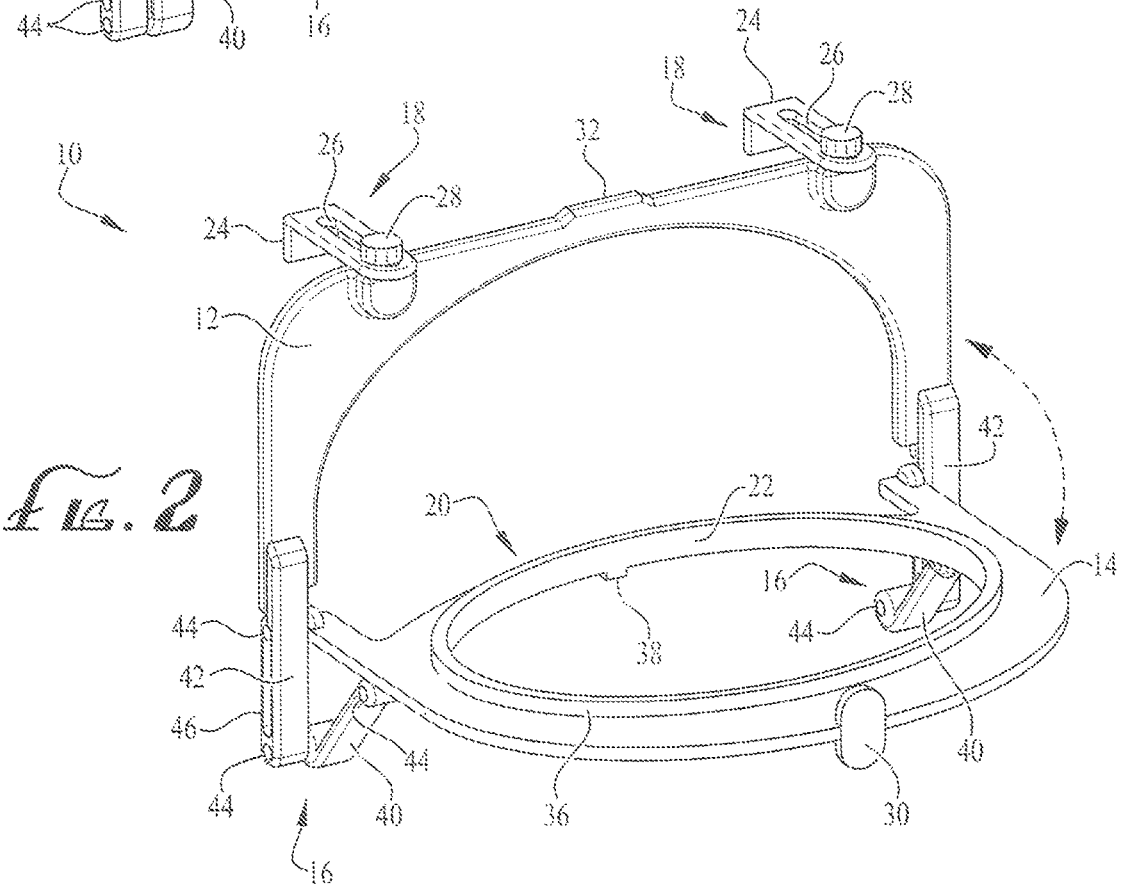
FIG. 2 illustrates the apparatus in an open configuration.
Figure 5:
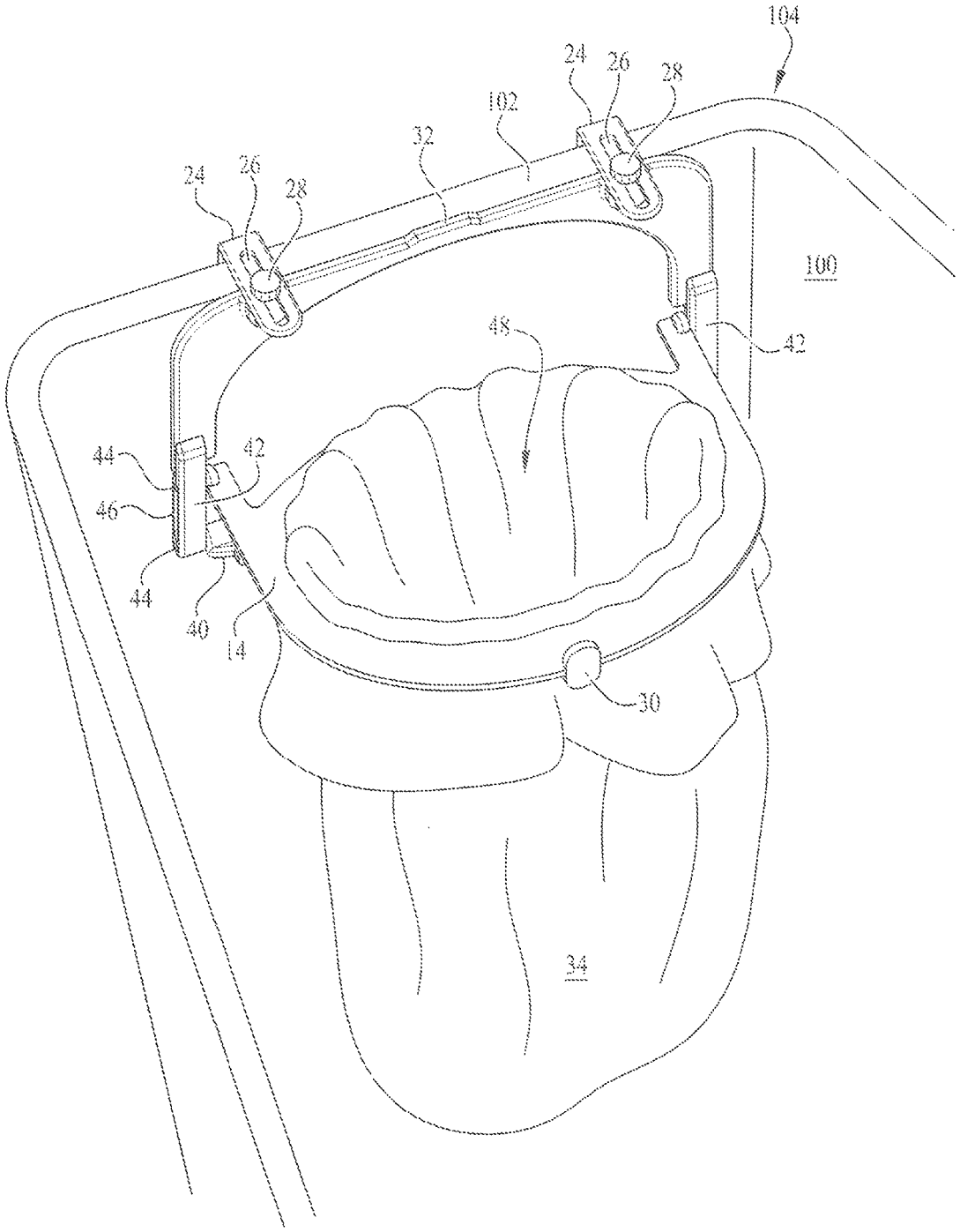
FIG. 5 illustrates the apparatus in the open configuration installed in a kitchen waste receptacle with the compost bag installed thereon.
Figure 6:
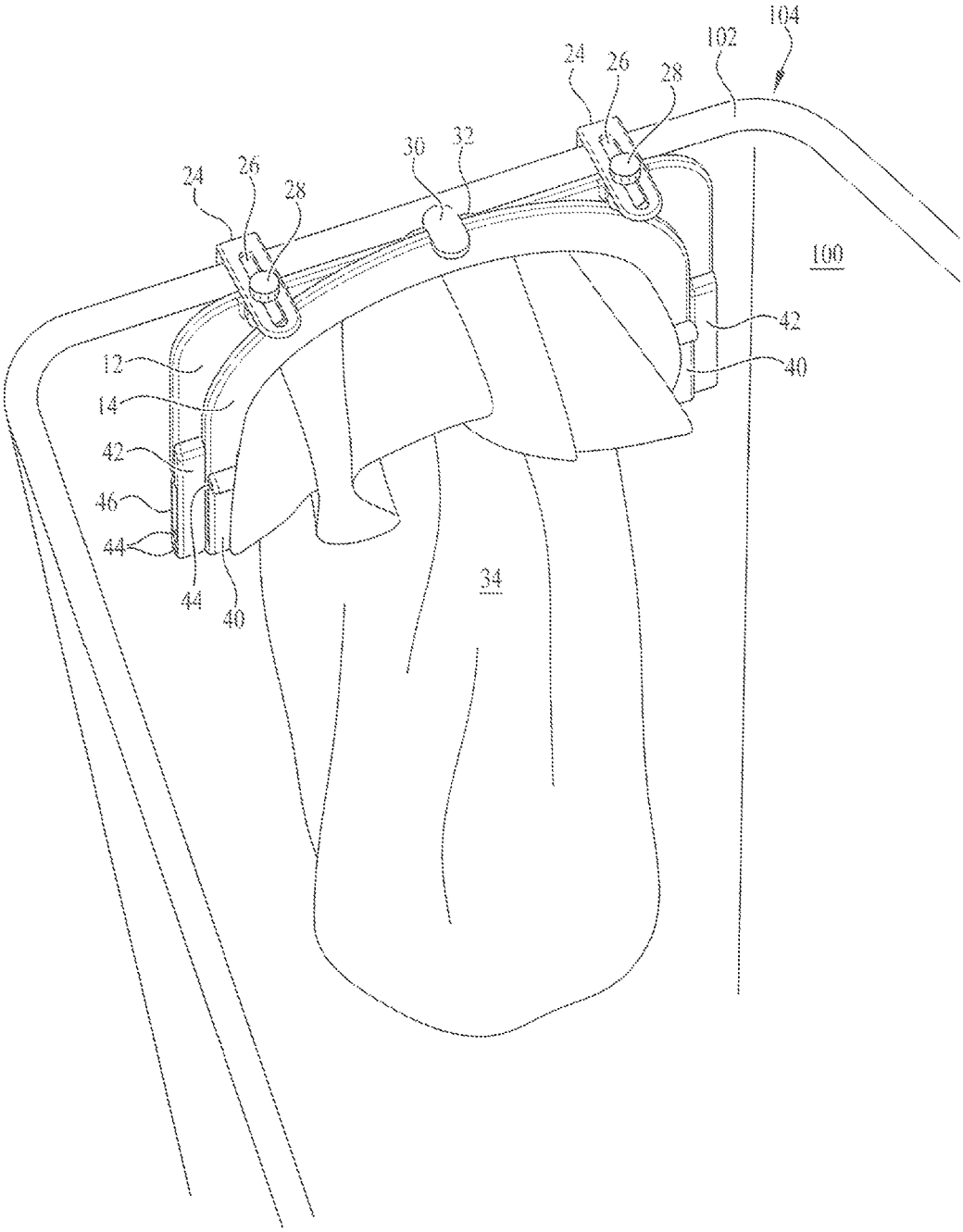
FIG. 6 illustrates the apparatus in a closed configuration installed in a kitchen waste receptacle with the compost bag installed thereon.

Referring to FIGS. 1-2, a collection apparatus 10 for storing organic waste (not shown) prior to transfer for compositing comprises a holder panel 12 and a cradle panel 14 connected together by one or more hinge mechanisms 16. The holder panel 12 includes one or more releasable attachments 18 for anchoring the apparatus 10 to a waste receptacle 100 (FIGS. 5-6), preferably a conventional lipped kitchen waste receptacle 100. The cradle panel 14 includes an aperture 20, and a bag retainer 22 seats in the aperture 20. Using the hinge mechanism 16, the cradle panel 14 moves relative to the holder panel 12 from a first position coplanar with the holder panel 12 as shown in FIG. 1 to a second position non-coplanar with the holder panel 12, preferably but not necessarily perpendicular thereto, as shown in FIG. 2.

The releasable attachment 18 may comprise hook members 24, adjustable relative to the holder panel 12. In one embodiment the hook members 24 may include channels 26 for sliding relative to the holder panel 12. For ease of adjustment, the hook members 24 may be aimed to the holder panel 12 using thumb screws 28, allowing users to quickly and easily adjust the hook members' 24 positions. By providing adjustable hook members 24, the holder panel 12 can be suspended from a variety of kitchen waste bins 100 having a variety of different rim 102 thicknesses, and can even be suspended across a corner 104 of a waste bin 100.

Figure 4:
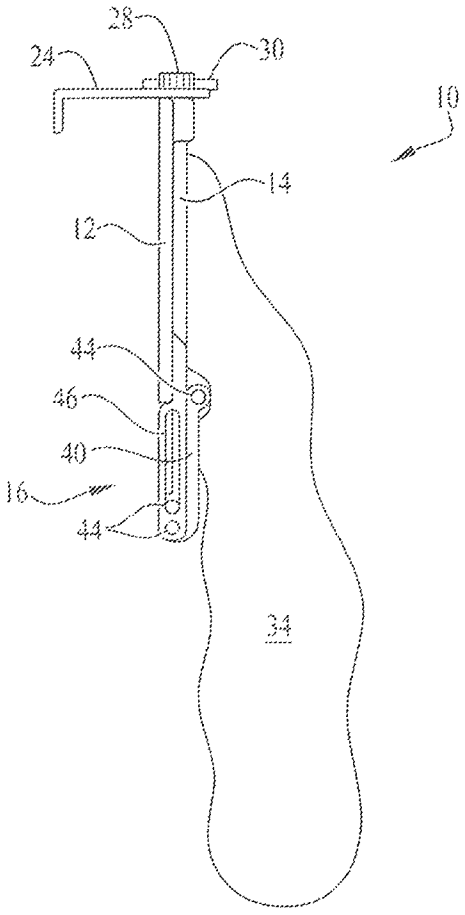
FIG. 4 illustrates the apparatus in the closed configuration with the compost bag installed thereon.
Figure 3:
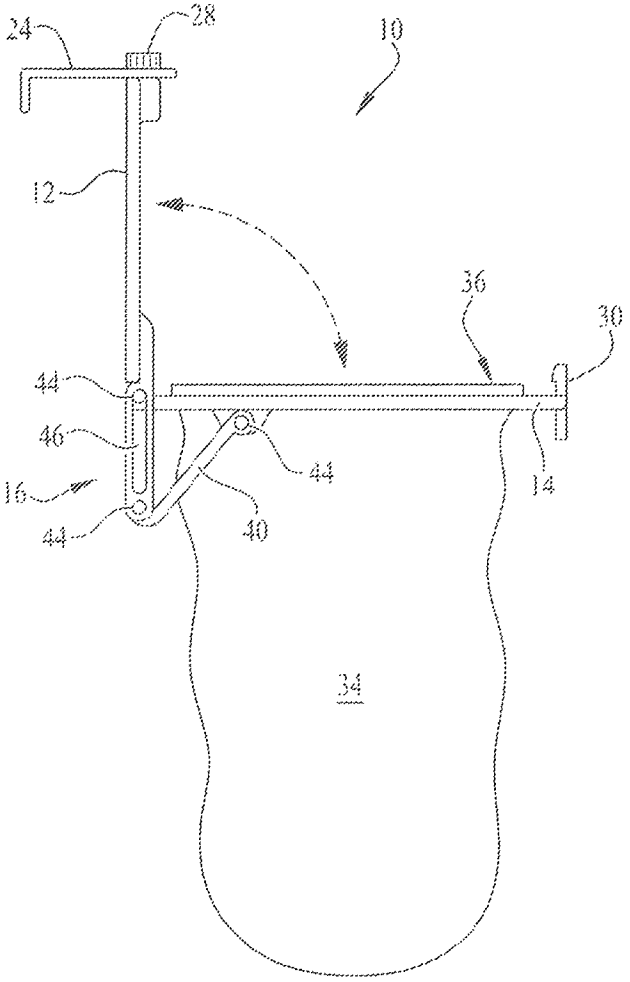
FIG. 3 illustrates the apparatus in the open configuration with a compost bag installed thereon for receiving compostable kitchen waste.

The cradle panel 14 includes a catch tab 30 for engaging a catch 32 on the holder panel 12 when the cradle panel 14 is folded up against the holder panel 12. The catch tab 30 and catch 32 are preferably positioned to engage each other in a pressure fit and the catch tab 30 is sized such that a user can grasp the catch tab 30, easily dislodge it from the catch 32 and allow the cradle panel 14 to fall into an open position under its own weight. The bag retainer 22 is preferably sized to extend both through the aperture 20 and extend around the edge of the aperture 20 to effectively trap and secure a compost bag 34 (FIGS. 3-4) into which organic kitchen waste is placed prior to composting. The aperture 20 and bag retainer 22 are preferably formed in an ovoid shape to promote a user's ability to insert the bag retainer 22 (with a compost bag 34 placed thereon) through the aperture 20, rotate it, and seat it in the aperture 20. The bag retainer 22 includes a lip 36 that prevents it from falling through the aperture 20 under the weight of organic material in the compost bag 34, and one or more releasable clips 38 located on the bag retainer 22 opposite the lip 36 hold the bag retainer 22 in the aperture 20 until released. Preferably the bag retainer 22 is sufficiently flexible to allow a user to easily deform the clips 38 for removing the bag retainer 22 and compost bag 34, while also sufficiently resilient such that the lip 36 supports a significant amount of weight in the compost bag 34.

The hinge mechanism 16 comprises a strut 40 and slider 42 allowing the cradle panel 14 to slide upward along the holder panel 12 as it rotates outward to allow access to the compost bag 34. Preferably the strut 40 is hingedly attached to the holder panel 12 and to the cradle panel 14 by pegs 44. A peg 44 also travels in the channel 46 of the slider 42. The peg 44 extending through the slider 42 may also have a tab (not shown) or similar structure to prevent it from dislodging from the channel 46. To make the apparatus 10 less expensive to manufacture and assemble, the slider 42 may be constructed separately from the holder panel 12 and attached thereto during assembly.

Referring to FIGS. 3-6, the collection apparatus 10 is shown with a compost bag 34 installed on the bag retainer 22 (FIGS. 1-2) with the cradle panel 14 in open (FIG. 4) and closed (FIG. 5) positions, respectively. The compost bag 34 has an opening 48 which is held open by wrapping around the bag retainer 22 seated in the aperture 20. When the cradle panel 14 is in the open configuration, the opening 48 is oriented upward, preferably co-planar with an opening (not shown) of the waste receptacle 100 on which the apparatus 10 is installed, allowing a user to easily separate kitchen waste into non-organic waste disposed in the waste bin, and organic waste disposed in the compost bag 34.

When the cradle panel 14 is moved to a closed position, the opening 48 is oriented to the side, facing the waste receptacle 100. Thus, the opening is obscured by the waste receptacle 100 preventing odors from decomposing organic material from escaping the compost bag 34. In many instances, depending on the level of organic material in the compost bag 34, moving the cradle panel 14 to a closed and upright position will also cause the compost bag 34 to fold over the opening 48 which also prevents odors from escaping the compost bag 34.

Figure 7:
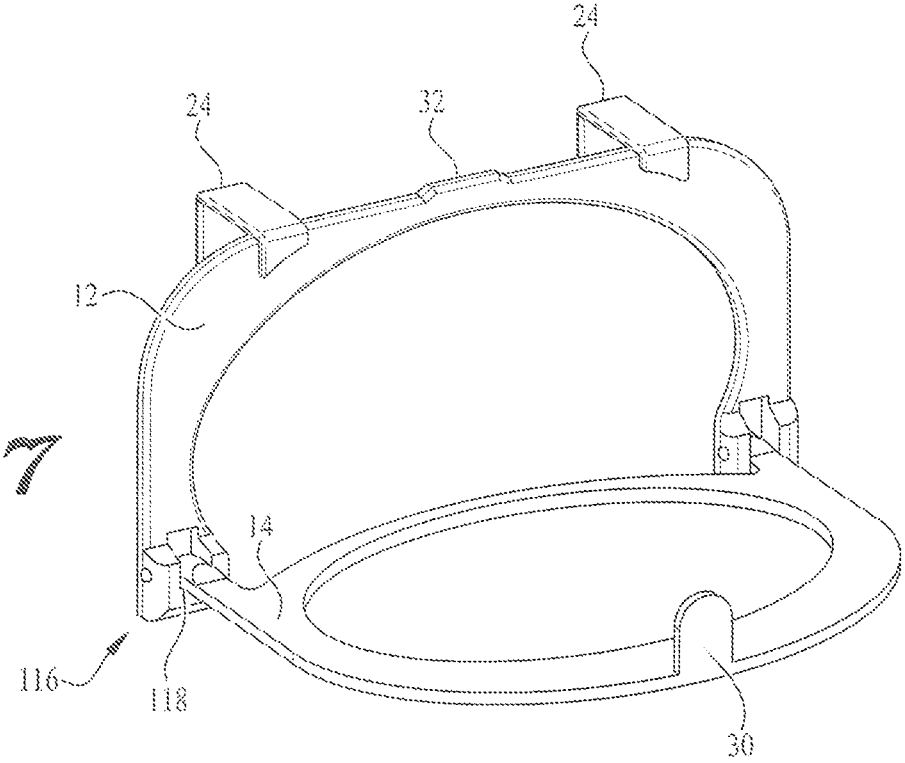
FIG. 7 illustrates the apparatus having an alternative embodiment hinge mechanism with a flexible attachment mechanism.
Figure 8:
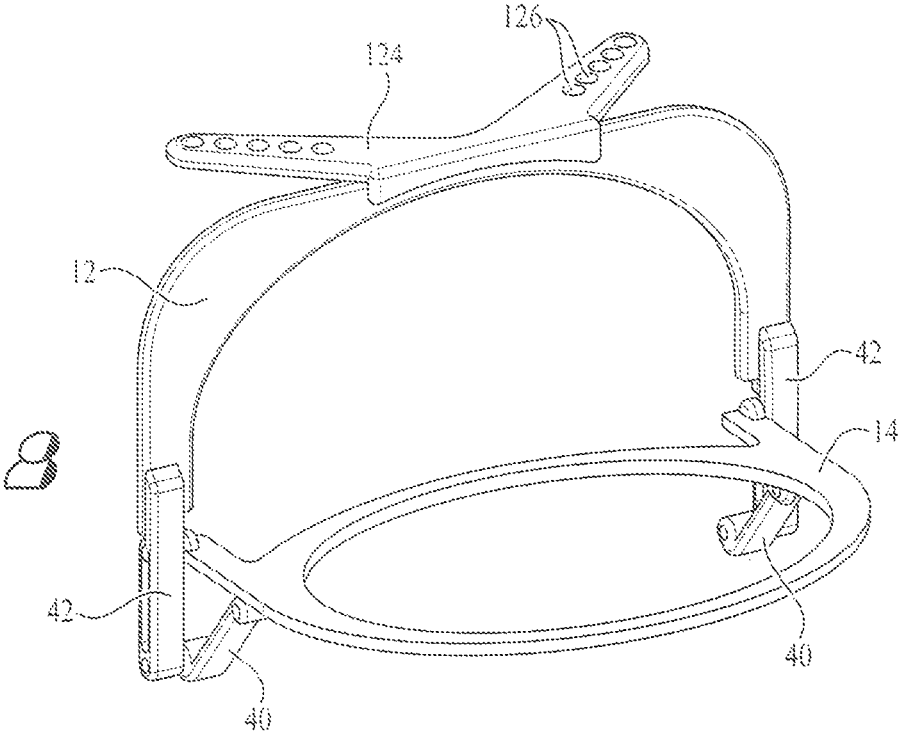
FIG. 8 illustrates the apparatus having an alternative embodiment attachment mechanism.

Referring to FIGS. 7-8 alternative embodiments of the apparatus 10 having different arrangements of hinge mechanisms releasable attachments may be employed according to preference. Referring to FIG. 7, an alternative embodiment hinge mechanism 116 is shown. The alternative embodiment hinge mechanism 116 represents a more conventional connection between the holder panel 12 and the cradle panel 14. In this embodiment, a stop 118 is provided to support the cradle panel 14 in a substantially horizontal orientation when open. In this embodiment, flexible clips are preferably used to allow the apparatus 10 to be installed in a variety of positions. Referring to FIG. 8, an alternative embodiment releasable attachment 124 is shown. In lieu of hooks, the releasable attachment includes a series of engagements 126 on two arms 128 oriented to hold the engagements 126 on corresponding structures on a waste receptacle.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

What is claimed is:

1. An apparatus for isolating compostable material in a kitchen waste receptacle, the apparatus comprising:

a holder panel having a releasable attachment for suspending the apparatus in the waste receptacle;

a cradle panel having an aperture, the cradle panel hingedly coupled to the holder panel and movable between a first position coplanar with the holder panel and a second position non-coplanar with the holder panel;

a bag retainer seated in the aperture for releasably holding a compost bag therebetween, the bag retainer defining an opening of the compost bag; and wherein the opening is occluded by the compost bag with the cradle panel in the first position, and the opening is clear of the compost bag when the cradle panel is in the second position.

2. The apparatus of claim 1 wherein the holder panel comprises an arced portion in substantially peripheral contour with the aperture.

3. The apparatus of claim 2 wherein the bag retainer extends through the arced portion when the cradle panel is brought against the holder panel in the first position.

4. The apparatus of claim 1 wherein the releasable attachment comprises hook members positionally adjustable relative to the holder panel.

5. The apparatus of claim 1 wherein the cradle panel comprises a lock for releasably engaging the holder panel thereby maintaining the cradle panel in the first position.

6. The apparatus of claim 1 wherein the aperture is elliptical.

7. The apparatus of claim 1 wherein the bag retainer extends through the aperture.

8. The apparatus of claim 7 wherein the bag retainer comprises a lip larger in circumference than the aperture.

9. The apparatus of claim 1 wherein the bag retainer comprises a catch for releasably engaging the aperture.

10. The apparatus of claim 1 further comprising a hinge mechanism coupling the cradle panel to the holder panel.

11. The apparatus of claim 10 wherein the hinge mechanism comprises an articulating strut and slider channel.

12. An apparatus for collecting compostable organic kitchen waste, the apparatus comprising:

a compost bag having an opening turned around a bag retainer;

the bag retainer seated in an aperture of a cradle panel, such that the compost bag is held between the bag retainer and the aperture;

the cradle panel hingedly coupled to a holder panel; and wherein the cradle panel is configured to rotate the bag retainer sufficient to occlude the opening with the compost bag.

13. The apparatus of claim 12 wherein the opening faces a waste receptacle when cradle panel rests against the holder panel.

14. The apparatus of claim 12 further comprising an adjustable releasable attachment coupled to the holder panel for suspending the apparatus in a waste receptacle.

15. The apparatus of claim 12 wherein the cradle panel comprises a lock for releasably engaging the holder panel, the lock comprising a thumb tab for grasping the cradle panel.

16. The apparatus of claim 12 wherein the bag retainer extends through the aperture.

17. The apparatus of claim 12 wherein the aperture and the bag retainer define an ellipse.

18. The apparatus of claim 12 wherein the bag retainer comprises a lip larger in circumference than the aperture, and further comprises a catch for releasably engaging the aperture.

19. The apparatus of claim 12 wherein the compost bag is biodegradable.

20. An apparatus for separately storing compostable material in a kitchen waste receptacle, the apparatus comprising:

a holder panel having an arced portion and an adjustable releasable attachment for suspending the apparatus in the waste receptacle;

a cradle panel having an aperture, the cradle panel hingedly coupled to the holder panel and movable between a first position coplanar with the holder panel and a second position non-coplanar with the holder panel;

the cradle panel further comprising a lock for releasably engaging the holder panel thereby maintaining the cradle panel in the first position;

a bag retainer seated in the aperture for releasably holding a compost bag therebetween, the bag retainer defining the opening of the compost bag as an elliptical opening, the bag retainer extending through the aperture;

wherein the bag retainer extends through the arced portion when the cradle panel rests against the holder panel; and wherein the opening is occluded by the compost bag when the cradle panel is in the first position, and the opening is clear of the compost bag when the cradle panel is in the second position.

* * * * *